US010555568B1

(12) United States Patent
Walker-Baldwin

(10) Patent No.: US 10,555,568 B1
(45) Date of Patent: Feb. 11, 2020

(54) PREMATURE INFANT CLOTHING

(71) Applicant: Shikeya Walker-Baldwin, Trenton, NJ (US)

(72) Inventor: Shikeya Walker-Baldwin, Trenton, NJ (US)

( * ) Notice: Subject to any disclaimer, the term of this patent is extended or adjusted under 35 U.S.C. 154(b) by 15 days.

(21) Appl. No.: 16/031,086

(22) Filed: Jul. 10, 2018

(51) Int. Cl.

| | |
|---|---|
| ***A41D 13/12*** | (2006.01) |
| ***A41B 11/00*** | (2006.01) |
| ***A42B 1/04*** | (2006.01) |
| *A41D 27/00* | (2006.01) |

(52) U.S. Cl.
CPC ..... *A41D 13/1272* (2013.01); *A41B 11/00* (2013.01); *A41D 13/1281* (2013.01); *A42B 1/04* (2013.01); *A41D 2300/32* (2013.01)

(58) Field of Classification Search
CPC .. A41D 15/00; A41D 13/129; A41D 13/1236; A41D 13/1281; A41D 13/1245; A41D 13/1272; A41D 2400/70; A41D 13/04; A41D 13/05; A41D 13/1254; A41D 1/21; A41D 1/22; A41D 2300/324; A41D 2300/33; A41D 13/0012; A41D 15/005; A41D 2300/32; A41B 13/06; A41B 13/00; A41B 2400/32; A41B 2500/52; A41B 9/08; A41B 2300/30; A41B 2300/32; A61B 2046/205; A61B 2046/236; A61B 46/00; A61B 5/6805; A61B 90/40
See application file for complete search history.

(56) References Cited

U.S. PATENT DOCUMENTS

| | | | | | |
|---|---|---|---|---|---|
| 1,489,046 | A * | 4/1924 | Thompson | A41B 9/08 | 2/114 |
| 2,297,159 | A * | 9/1942 | Mohler | A41D 1/21 | 2/76 |
| 2,613,359 | A * | 10/1952 | Boyce | A41B 13/06 | 2/69.5 |
| 2,722,686 | A * | 11/1955 | Hoskings | A41D 15/00 | 2/74 |
| 2,808,590 | A * | 10/1957 | Siegel | A41B 13/00 | 2/80 |
| 3,116,491 | A * | 1/1964 | Previdi | A41D 1/21 | 2/106 |

(Continued)

FOREIGN PATENT DOCUMENTS

WO 2004043178 5/2004

*Primary Examiner* — Robert H Muromoto, Jr.

(57) ABSTRACT

The premature infant clothing is a therapeutic garment. The premature infant clothing is configured for use with a patient. The patient is a low birthweight infant receiving medical therapy. The therapy further comprises medical tubing. The premature infant clothing comprises a plurality of panels and a plurality of detachable fasteners. The plurality of panels are interconnected using the plurality of detachable fasteners to form a plurality of garments. Each of the plurality of panels is a textile. The plurality of detachable fasteners removably attach one or more panels selected from the plurality of panels to form a garment selected from the plurality of garments. The plurality of detachable fasteners are adjustable such that any detachable fastener selected from the plurality of detachable fasteners can be reconfigured to accommodate the insertion of the medical tubing through the selected detachable fastener.

15 Claims, 9 Drawing Sheets

(56) References Cited

U.S. PATENT DOCUMENTS 3,276,036 A * 10/1966 Cater ..... A41D 13/1236 2/114
4,142,253 A * 3/1979 Roscoe ..... A41D 1/22 2/74
4,156,969 A * 6/1979 Werber ..... A41H 3/015 33/14
4,631,765 A * 12/1986 Casey ..... A47G 9/0207 428/33
4,759,083 A * 7/1988 Belcher ..... A41D 13/1236 2/114
5,062,159 A * 11/1991 Jakub ..... A41D 13/1236 2/105
D349,595 S 8/1994 Miltz, Jr.
5,592,691 A * 1/1997 Ronald ..... A41D 15/00 2/243.1
5,621,917 A * 4/1997 Howsden ..... A41B 13/06 2/111
5,628,064 A * 5/1997 Chung ..... A41D 15/00 2/119
5,718,000 A * 2/1998 Ost ..... A41D 3/00 2/102
5,894,600 A * 4/1999 Chenefront ..... A41D 15/00 2/105
6,694,521 B1 2/2004 Hopkins
7,810,172 B2 10/2010 Williams
8,075,366 B1 * 12/2011 Jaksic ..... A41C 3/08 2/105
8,832,864 B1 9/2014 Braden
10,092,045 B2 * 10/2018 Smith ..... A41D 15/00
10,219,558 B2 * 3/2019 Terrell ..... A41D 13/1245
10,299,522 B2 * 5/2019 Kuo ..... A41D 13/1263
2003/0060831 A1 * 3/2003 Bonutti ..... A41D 19/0157 606/86 R
2003/0092544 A1 * 5/2003 Reed ..... A63B 21/0603 482/105
2003/0177563 A1 * 9/2003 Reich ..... A41D 13/1263 2/75
2006/0048262 A1 * 3/2006 Sencion ..... A41D 15/00 2/69
2007/0094761 A1 * 5/2007 Kolmes ..... A41D 13/015 2/69
2009/0031471 A1 * 2/2009 Dague ..... A41D 13/1245 2/83
2015/0201686 A1 * 7/2015 Gauthier ..... A41D 15/00 2/69
2015/0237932 A1 * 8/2015 Carryl ..... A41D 13/1254 2/69
2015/0272240 A1 * 10/2015 Smith ..... A41D 15/00 2/69
2016/0021950 A1 * 1/2016 Rafieiankopaei ..... A41D 15/00 2/243.1
2017/0055592 A1 * 3/2017 Stephan ..... A41B 13/06
2017/0143977 A1 * 5/2017 Kaib ..... A41D 13/1281

* cited by examiner

PREMATURE INFANT CLOTHING

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including apparel, more specifically, a patient gown characterized by the donning facilities.

SUMMARY OF INVENTION

The premature infant clothing comprises a therapeutic garment. The premature infant clothing is configured for use with a patient. The patient is a low birthweight infant receiving medical therapy. The therapy further comprises medical tubing. The premature infant clothing comprises a plurality of panels and a plurality of detachable fasteners. The plurality of panels are interconnected using the plurality of detachable fasteners to form a plurality of garments. Each of the plurality of panels is a textile. The plurality of detachable fasteners removably attach one or more panels selected from the plurality of panels to form a garment selected from the plurality of garments. The plurality of detachable fasteners are adjustable such that any detachable fastener selected from the plurality of detachable fasteners can be reconfigured to accommodate the insertion of the medical tubing through the selected detachable fastener.

Each garment selected from the plurality of garment consists of one or more panels selected from the plurality of panels and one or more detachable fasteners selected from the plurality of detachable fasteners. The plurality of panels refers to each individual panel contained in the plurality of panels as they are described in this disclosure. The plurality of detachable fasteners refers to each individual fastener contained in the plurality of detachable fasteners as they are described in this disclosure. This paragraph is specifically intended to convey the inventive concept that no permanent attachments are used to assembly any garment selected from the plurality of garments.

These together with additional objects, features and advantages of the premature infant clothing will be readily apparent to those of ordinary skill in the art upon reading the following detailed description of the presently preferred, but nonetheless illustrative, embodiments when taken in conjunction with the accompanying drawings.

In this respect, before explaining the current embodiments of the premature infant clothing in detail, it is to be understood that the premature infant clothing is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the premature infant clothing.

It is therefore important that the claims be regarded as including such equivalent construction insofar as they do not depart from the spirit and scope of the premature infant clothing. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
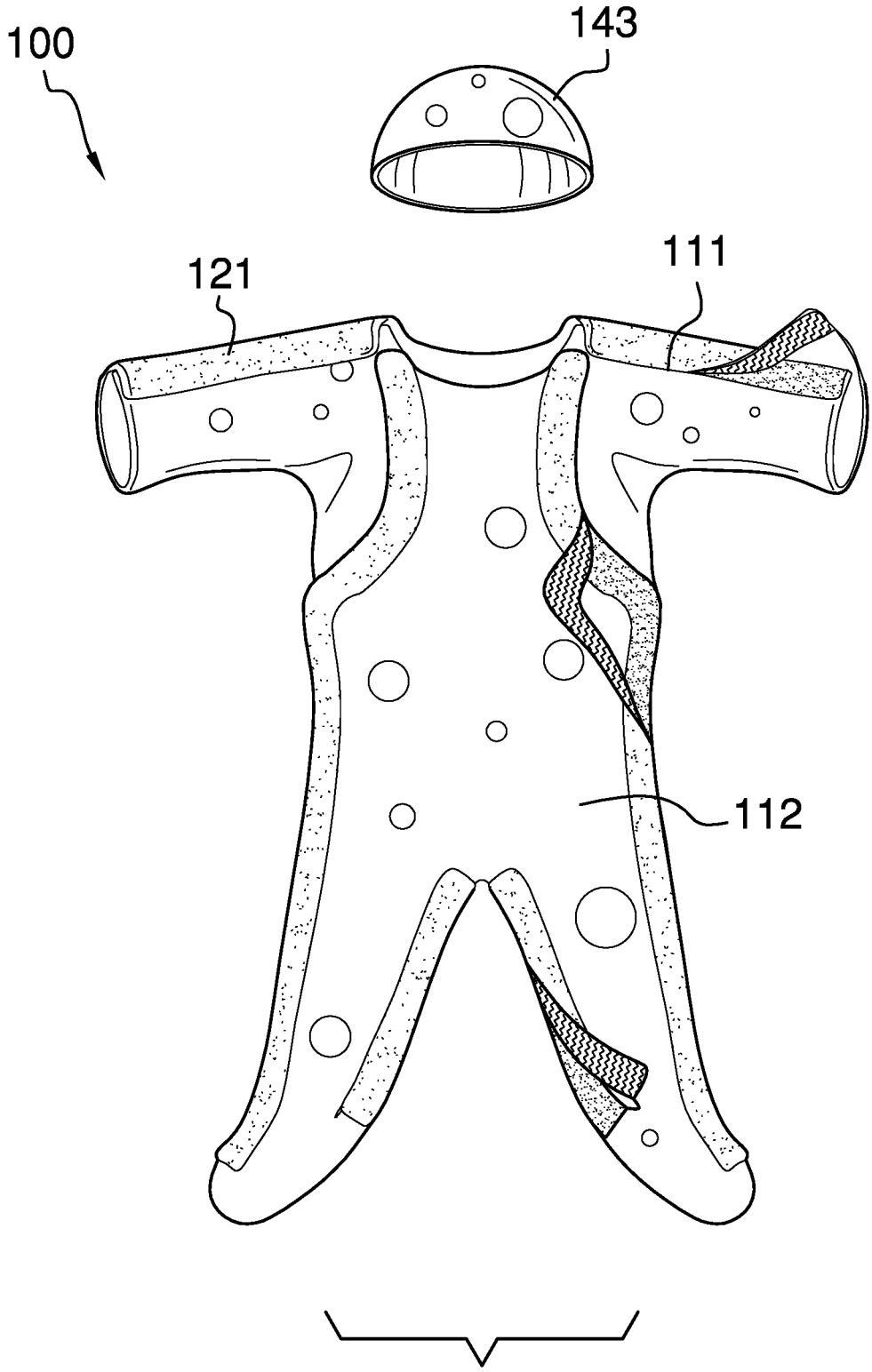
FIG. 1 is a front view of an embodiment of the disclosure.
Figure 2:
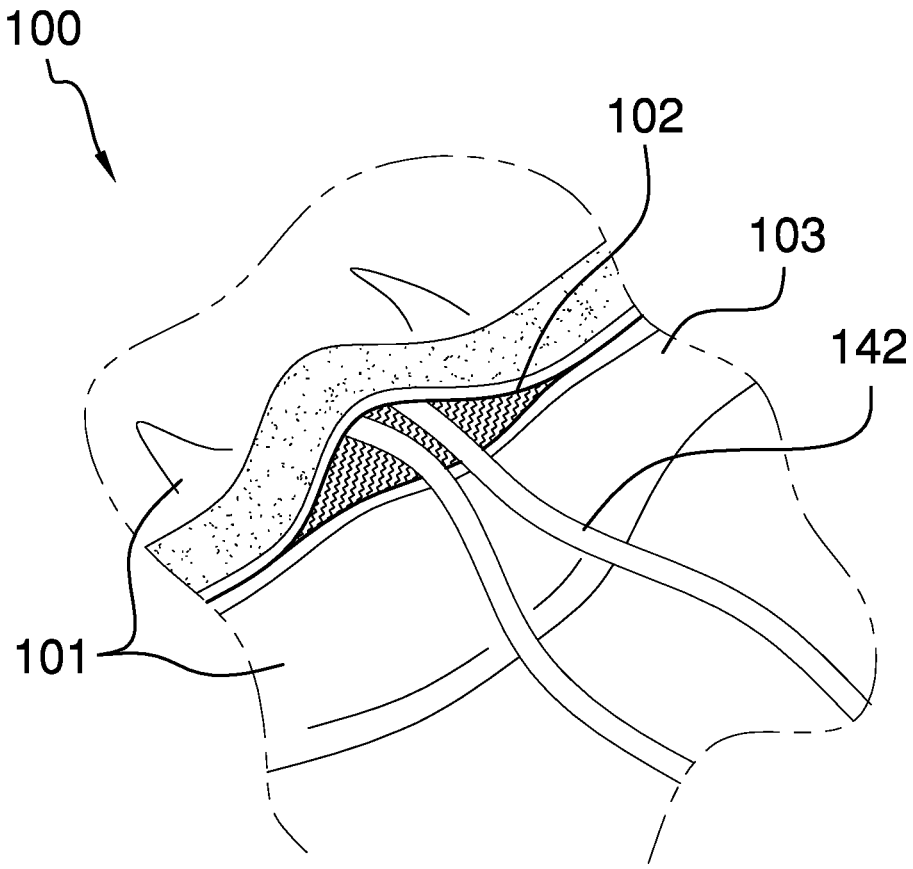
FIG. 2 is a detail view of an embodiment of the disclosure.
Figure 3:
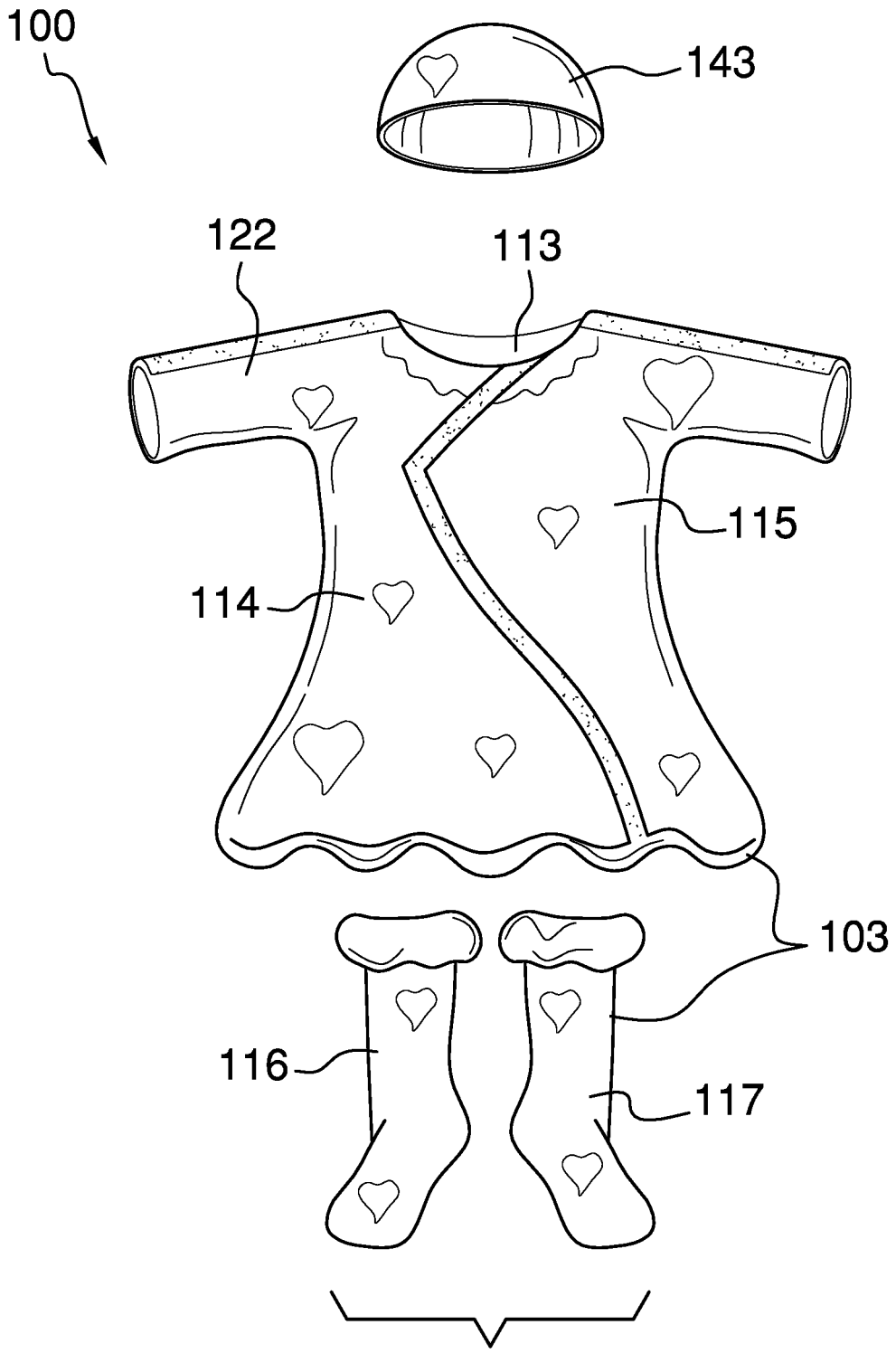
FIG. 3 is a front view of an alternative embodiment of the disclosure.
Figure 4:
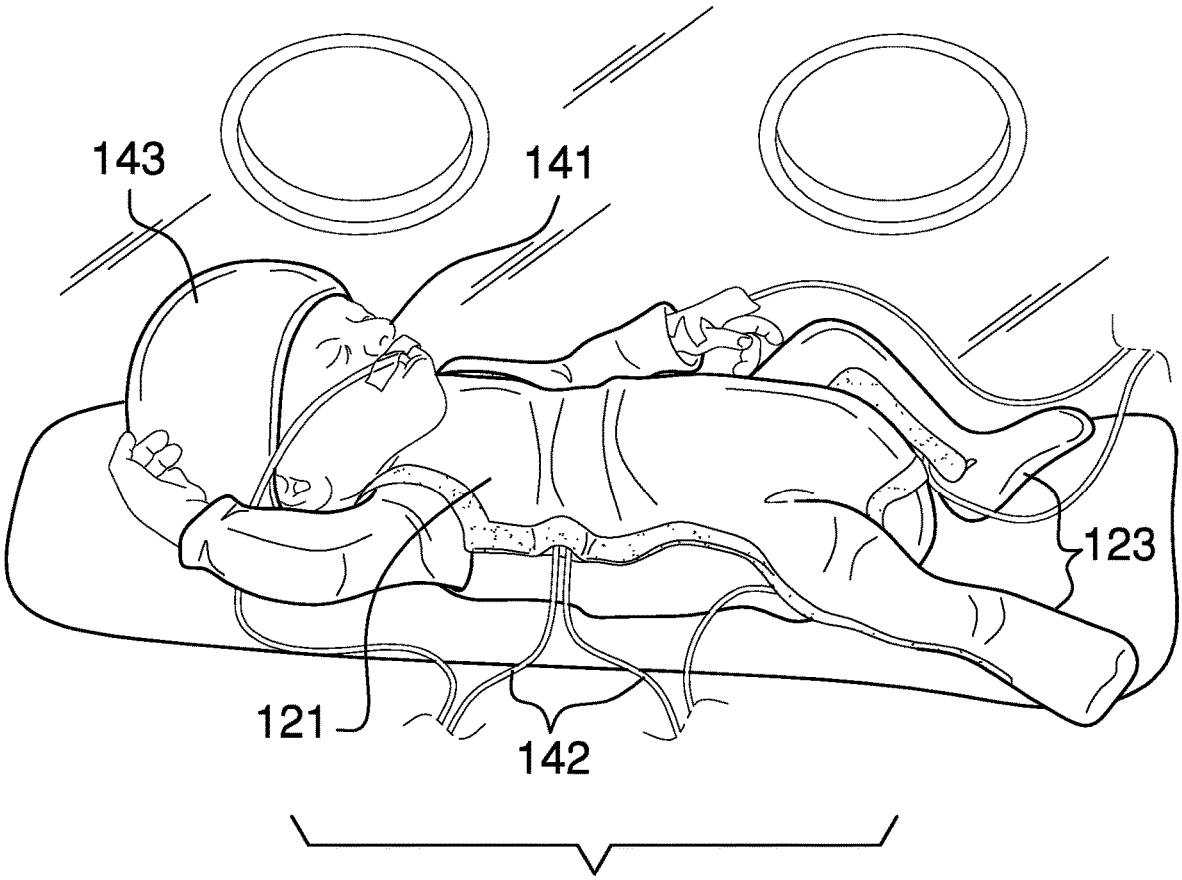
FIG. 4 is an in-use view of an embodiment of the disclosure.
Figure 5:
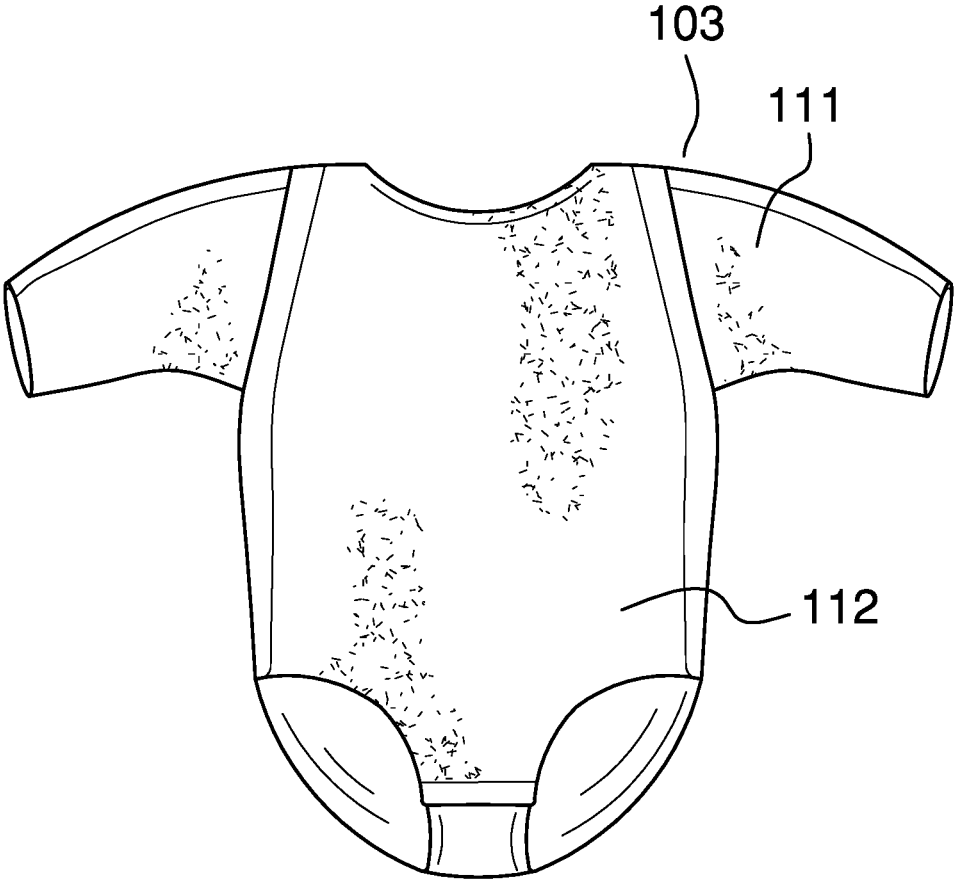
FIG. 5 is a front view of an alternative embodiment of the disclosure.
Figure 6:
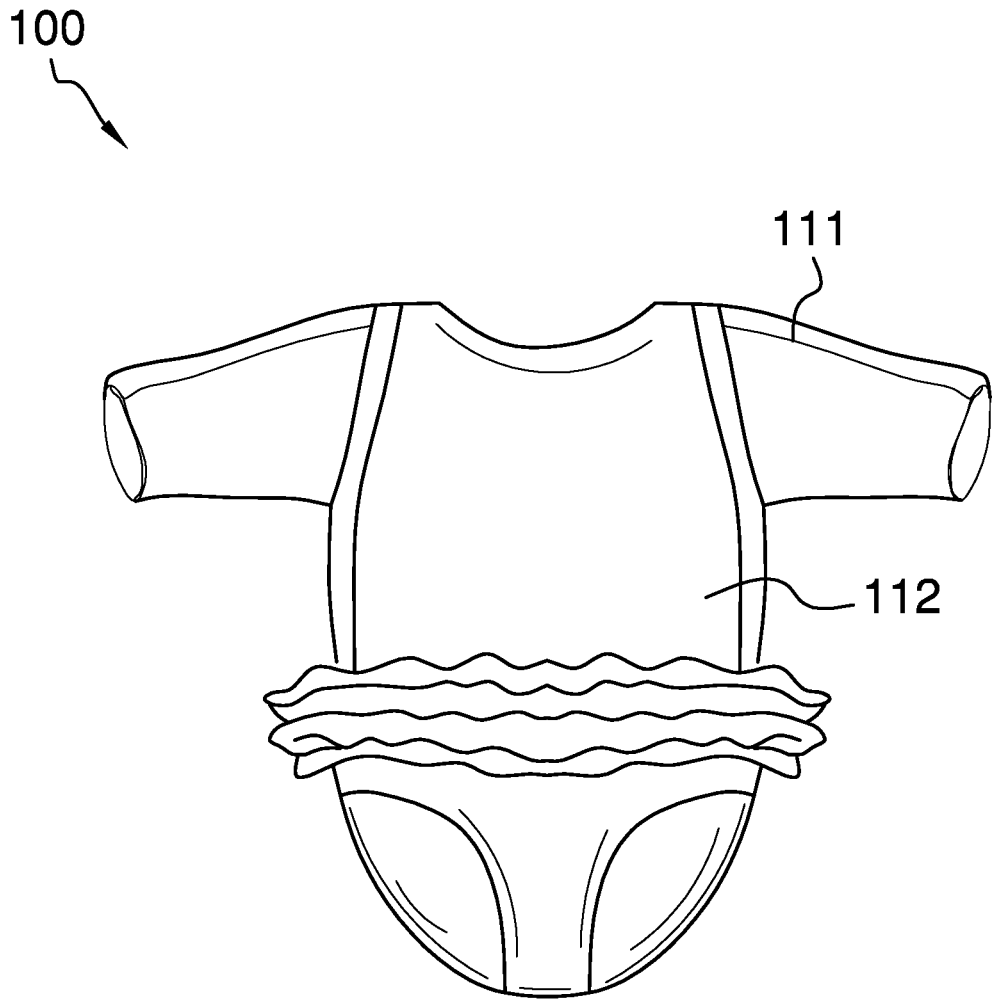
FIG. 6 is a front view of an alternative embodiment of the disclosure.
Figures 7, 8:
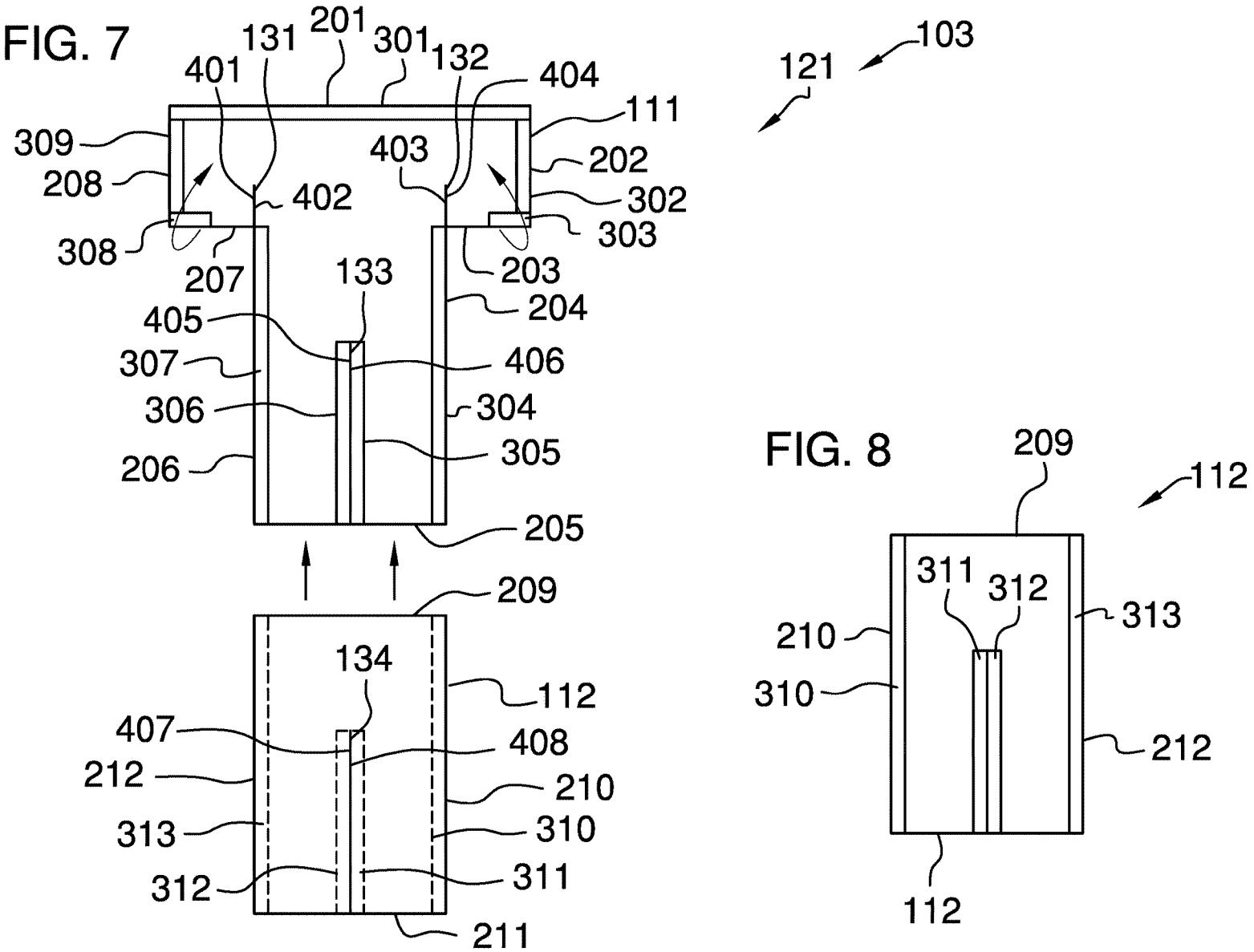
FIG. 7 is a detail view of an embodiment of the disclosure.
FIG. 8 is a detail view of an embodiment of the disclosure.
Figure 9:
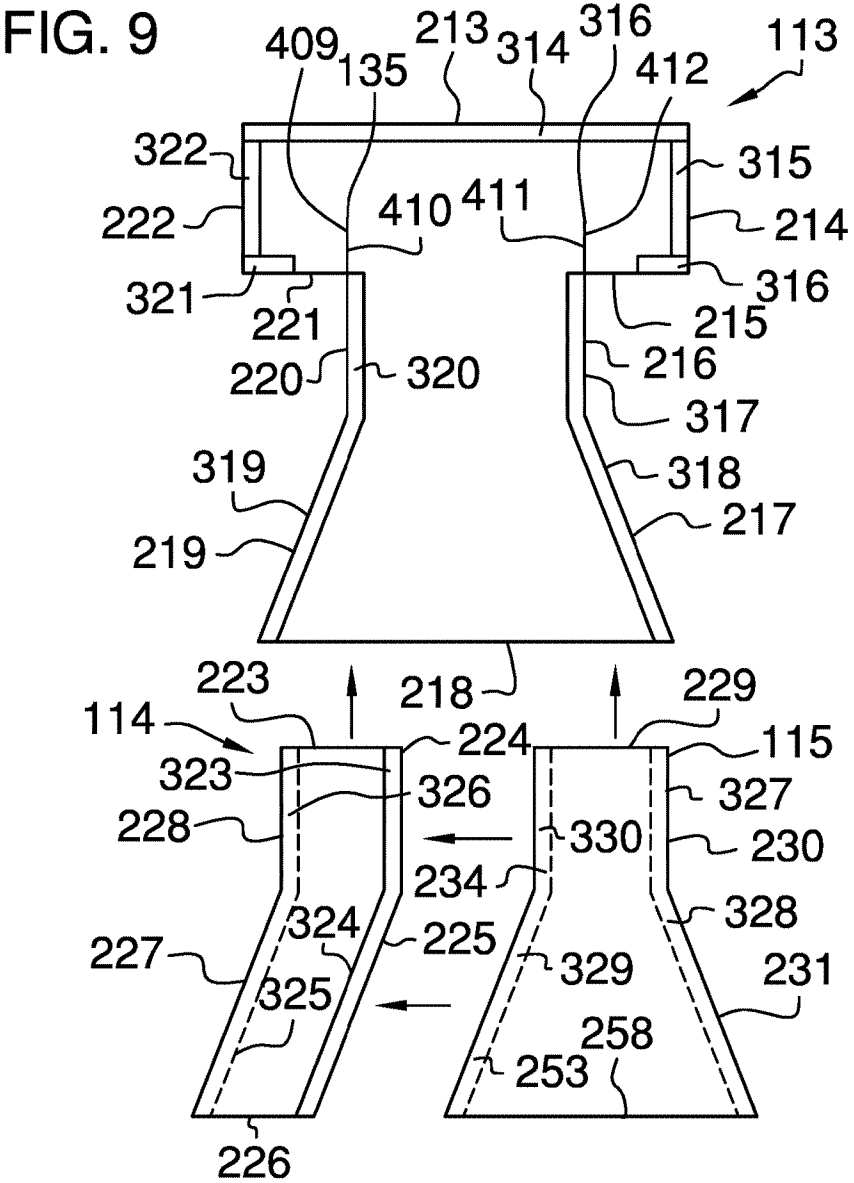
FIG. 9 is a detail view of an embodiment of the disclosure.
Figure 10:
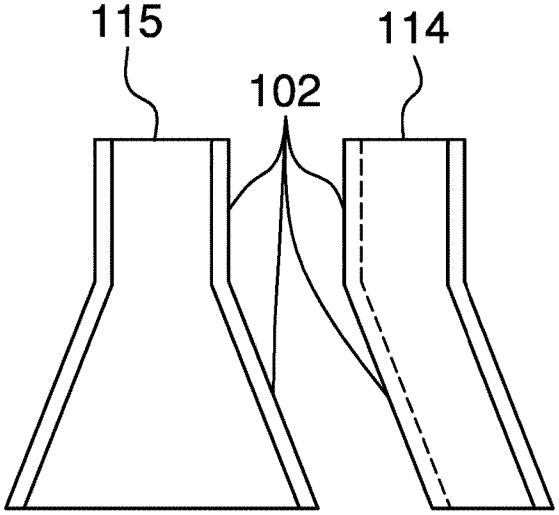
FIG. 10 is a detail view of an embodiment of the disclosure.
Figure 11:
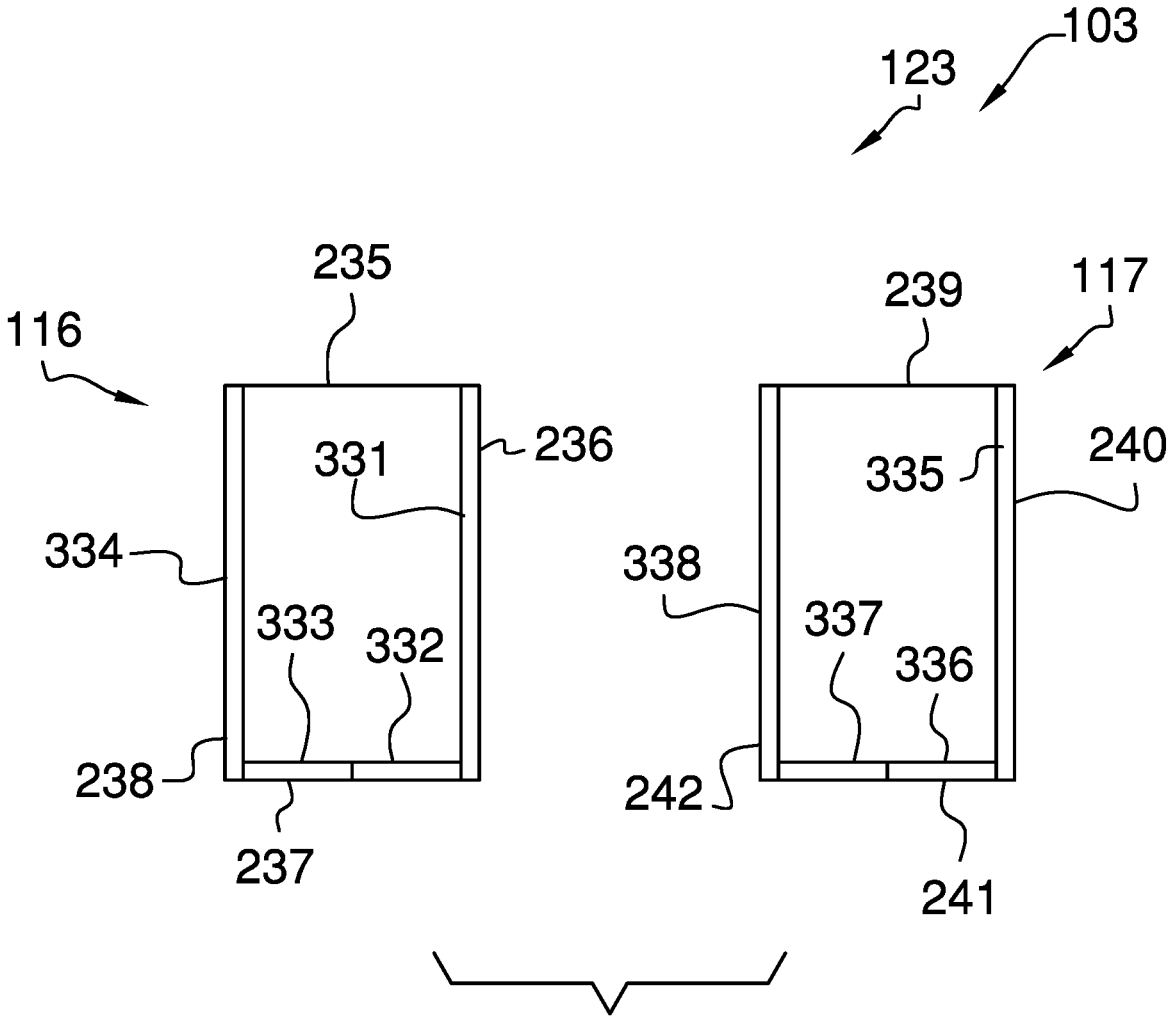
FIG. 11 is a detail view of an embodiment of the disclosure.

Detailed reference will now be made to one or more potential embodiments of the disclosure, which are illustrated in FIGS. 1 through 11.

The premature infant clothing 100 (hereinafter invention) is a therapeutic garment. The invention 100 is configured for use with a patient 141. The patient 141 is a low birthweight infant receiving medical therapy. The therapy further comprises medical tubing 142. The invention 100 comprises a plurality of panels 101 and a plurality of detachable fasteners 102. The plurality of panels 101 are interconnected using the plurality of detachable fasteners 102 to form a plurality of garments 103. Each of the plurality of panels 101 is a textile. The plurality of detachable fasteners 102 removably attach one or more panels selected from the plurality of panels 101 to form a garment selected from the plurality of garments 103. The plurality of detachable fasteners 102 are adjustable such that any detachable fastener selected from the plurality of detachable fasteners 102 can be reconfigured to accommodate the insertion of the medical tubing 142 through the selected detachable fastener. The invention 100 is configured for use with a cap 143. The cap 143 is a covering worn to prevent the loss of body heat through the head of the patient 141.

Each garment selected from the plurality of garment 103 consists of one or more panels selected from the plurality of panels 101 and one or more detachable fasteners selected from the plurality of detachable fasteners 102. The plurality of panels 101 refers to each individual panel contained in the plurality of panels 101 as they are described in this disclosure. The plurality of detachable fasteners 102 refers to each individual fastener contained in the plurality of detachable fasteners 102 as they are described in this disclosure. This paragraph is specifically intended to convey the inventive concept that no permanent attachments are used to assembly any garment selected from the plurality of garments 103.

Each of the plurality of panels 101 is a textile. Each of the plurality of panels 101 is cut into a rectilinear shape. Each of the plurality of panels 101 are used to form one or more garments selected from the plurality of garments 103. The plurality of panels 101 comprises a first panel 111, a second panel 112, a third panel 113, a fourth panel 114, a fifth panel 115, a sixth panel 116, and a seventh panel 117.

The first panel 111 is a textile that is cut in the shape of a cruciform. The first panel 111 is further defined with a first edge 201, a second edge 202, a third edge 203, a fourth edge 204, a fifth edge 205, a sixth edge 206, a seventh edge 207, and an eighth edge 208.

The second panel 112 is a textile that is cut in the shape of a rectangle. The second panel 112 is further defined with a ninth edge 209, a tenth edge 210, an eleventh edge 211, and a twelfth edge 212.

The third panel 113 is a textile that is cut in a rectilinear shape. The third panel 113 is formed in a manner similar to the first panel 111 but further comprises two flaired edges that widen the width of one of the arms of the cruciform shape. The third panel 113 is further defined with a thirteenth edge 213, a fourteenth edge 214, a fifteenth edge 215, a sixteenth edge 216, a seventeenth edge 217, an eighteenth edge 218, a nineteenth edge 219, a twentieth edge 220, a twenty-first edge 221, and a twenty-second edge 222.

The fourth panel 114 is a textile that is cut in a rectilinear shape. The fourth panel 114 is further defined with a twenty-third edge 223, a twenty-fourth edge 224, a twenty-fifth edge 225, a twenty-sixth edge 226, a twenty-seventh edge 227, and a twenty-eighth edge 228.

The fifth panel 115 is a textile that is cut in a rectilinear shape. The fifth panel 115 is further defined with a twenty-ninth edge 229, a thirtieth edge 230, a thirty-first edge 231, a thirty-second edge 232, a thirty-third edge 233, and a thirty-fourth edge 234.

The sixth panel 116 is a textile that is cut in the shape of a rectangle. The sixth panel 116 is further defined with a thirty-fifth edge 235, a thirty-sixth edge 236, a thirty-seventh edge 237, and a thirty-eighth edge 238.

The seventh panel 117 is a textile that is cut in the shape of a rectangle. The seventh panel 117 is further defined with a thirty-ninth edge 239, a fortieth edge 240, a forty-first edge 241, and a forty-second edge 242.

The first panel 111 further comprises a first slit 131, a second slit 132, and a third slit 133. The first slit 131 is a vent cut in the first panel 111 that allows for the freedom of movement of the arms of the patient 141. The second slit 132 is a vent cut in the first panel 111 that allows for the freedom of movement of the arms of the patient 141. The third slit 133 is a vent cut in the first panel 111 that allows for the freedom of movement of the legs of the patient 141. The first slit 131 forms a first raw edge 401 and a second raw edge 402. The second slit 132 forms a third raw edge 403 and a fourth raw edge 404. The third slit 133 forms a fifth raw edge 405 and a sixth raw edge 406.

The second panel 112 further comprises a fourth slit 134. The fourth slit 134 is a vent cut in the second panel 112 that allows for the freedom of movement of the legs of the patient 141. The fourth slit 134 forms a seventh raw edge 407 and an eighth raw edge 408. The fifth slit 135 forms a ninth raw edge 409 and a tenth raw edge 410. The sixth slit 136 forms an eleventh raw edge 411 and a twelfth raw edge 412.

The third panel 113 further comprises a fifth slit 135 and a sixth slit 136. The fifth slit 135 is a vent cut in the third panel 113 that allows for the freedom of movement of the arms of the patient 141. The sixth slit 136 is a vent cut in the third panel 113 that allows for the freedom of movement of the arms of the patient 141.

Each of the plurality of detachable fasteners 102 is a hook/loop surface used to form a hook and loop fastener. A primary hook/loop surface selected from the plurality of detachable fasteners 102 attaches to a secondary hook/loop surface selected from the plurality of detachable fasteners 102 to form an attachment selected from the group consisting of: a) attaching a primary panel selected from the plurality of panels 101 to a secondary panel selected from the plurality of panels 101; and, b) attaching a primary panel selected from the plurality of panels 101 to itself. The use of hook and loop fasteners is well-known and documented in the textile and apparel arts. The hook and loop fastener and the associated hook/loop surface are defined in greater detail elsewhere in this disclosure.

The plurality of detachable fasteners 102 comprises a first hook/loop surface 301, a second hook/loop surface 302, a third hook/loop surface 303, a fourth hook/loop surface 304, a fifth hook/loop surface 305, a sixth hook/loop surface 306, a seventh hook/loop surface 307, an eighth hook/loop surface 308, an ninth hook/loop surface 309, a tenth hook/loop surface 310, an eleventh hook/loop surface 311, a twelfth hook/loop surface 312, a thirteenth hook/loop surface 313, a fourteenth hook/loop surface 314, a fifteenth hook/loop surface 315, a sixteenth hook/loop surface 316, a seventeenth hook/loop surface 317, an eighteenth hook/loop surface 318, and a nineteenth hook/loop surface 319.

The plurality of detachable fasteners 102 further comprises a twentieth hook/loop surface 320, a twenty-first hook/loop surface 321, a twenty-second hook/loop surface 322, a twenty-third hook/loop surface 323, a twenty-fourth hook/loop surface 324, a twenty-fifth hook/loop surface 325, a twenty-sixth hook/loop surface 326, a twenty-seventh hook/loop surface 327, a twenty-eighth hook/loop surface 328, a twenty-ninth hook/loop surface 329, a thirtieth hook/loop surface 330, a thirty-first hook/loop surface 331, a thirty-second hook/loop surface 332, a thirty-third hook/loop surface 333, a thirty-fourth hook/loop surface 334, a thirty-fifth hook/loop surface 335, a thirty-sixth hook/loop surface 336, a thirty-seventh hook/loop surface 337, and a thirty-eighth hook/loop surface 338.

Each of the plurality of garments 103 is an article of apparel that is worn by the patient 141. The assembly of any garment selected from the plurality of garments 103 allows for the medical tubing 142 required for the care of the patient 141 to be inserted through the selected garment at any point along any seam that joins two panels selected from the plurality of panels 101. The plurality of garments 103 comprises a jumpsuit 121, a dress 122, and a pair of socks 123. The jumpsuit 121, the dress 122, and the pair of socks 123 are coordinated for use with the cap 143.

The jumpsuit 121 is a garment that assumes the appearance of a shirt and pants. The jumpsuit 121 covers the torso and the legs of the patient 141. In a second potential embodiment of the disclosure, shown most clearly in FIGS. 5 and 6, jumpsuit 121, the panels selected from the plurality of panels 101 are formed such that the jumpsuit 121 gives the appearance of a pair of shorts.

The dress 122 is a garment that assumes the appearance of a dress 122. The dress 122 covers the torso of the patient 141.

The pair of socks 123 is a garment that assumes the appearance of a pair of socks 123. The pair of socks 123 covers the legs and feet of the patient 141.

The following three paragraphs describe the assembly of the first panel 111.

An adhesive attaches the first hook/loop surface 301 to the first edge 201 of the first panel 111 such that the first hook/loop surface 301 aligns with the first edge 201. An adhesive attaches the second hook/loop surface 302 to the second edge 202 of the first panel 111 such that the second hook/loop surface 302 aligns with the second edge 202. An adhesive attaches the third hook/loop surface 303 to the third edge 203 of the first panel 111 such that the third hook/loop surface 303 aligns with the third edge 203. An adhesive attaches the fourth hook/loop surface 304 to the fourth edge 204 of the first panel 111 such that the fourth hook/loop surface 304 aligns with the fourth edge 204. An adhesive attaches the fifth hook/loop surface 305 to the sixth raw edge 406 of the first panel 111 such that the fifth hook/loop surface 305 aligns with the sixth raw edge 406.

An adhesive attaches the sixth hook/loop surface 306 to the fifth raw edge 405 of the first panel 111 such that the sixth hook/loop surface 306 aligns with the fifth raw edge 405. An adhesive attaches the seventh hook/loop surface 307 to the sixth edge 206 of the first panel 111 such that the seventh hook/loop surface 307 aligns with the sixth edge 206. An adhesive attaches the eighth hook/loop surface 308 to the seventh edge 207 of the first panel 111 such that the eighth hook/loop surface 308 aligns with the seventh edge 207. An adhesive attaches the ninth hook/loop surface 309 to the eighth edge 208 of the first panel 111 such that the ninth hook/loop surface 309 aligns with the eighth edge 208.

The first slit 131 is formed in the first panel 111 at the corner formed by the sixth edge 206 and the seventh edge 207. The first slit 131 projects towards the first edge 201 in a direction parallel to the sixth edge 206. The second slit 132 is formed in the first panel 111 at the corner formed by the third edge 203 and the fourth edge 204. The second slit 132 projects towards the first edge 201 in a direction parallel to the fourth edge 204. The third slit 133 is formed in the first panel 111 at the midpoint of the fifth edge 205. The third slit 133 projects towards the first edge 201 in a direction perpendicular to the fifth edge 205.

This paragraph describes the assembly of the second panel 112. An adhesive attaches the tenth hook/loop surface 310 to the tenth edge 210 of the second panel 112 such that the tenth hook/loop surface 310 aligns with the tenth edge 210. An adhesive attaches the eleventh hook/loop surface 311 to the eighth raw edge 408 of the second panel 112 such that the eleventh hook/loop surface 311 aligns with the eighth raw edge 408. An adhesive attaches the twelfth hook/loop surface 312 to the seventh raw edge 407 of the second panel 112 such that the twelfth hook/loop surface 312 aligns with the seventh raw edge 407. An adhesive attaches the thirteenth hook/loop surface 313 to the twelfth edge 212 of the second panel 112 such that the thirteenth hook/loop surface 313 aligns with the twelfth edge 212. The fourth slit 134 is formed in the second panel 112 at the midpoint of the eleventh edge 211. The fourth slit 134 projects towards the ninth edge 209 in a direction perpendicular to the eleventh edge 211.

The following three paragraphs describe the assembly of the third panel 113.

An adhesive attaches the fourteenth hook/loop surface 314 to the thirteenth edge 213 of the third panel 113 such that the fourteenth hook/loop surface 314 aligns with the thirteenth edge 213. An adhesive attaches the fifteenth hook/loop surface 315 to the fourteenth edge 214 of the third panel 113 such that the fifteenth hook/loop surface 315 aligns with the fourteenth edge 214. An adhesive attaches the sixteenth hook/loop surface 316 to the fifteenth edge 215 of the third panel 113 such that the sixteenth hook/loop surface 316 aligns with the fifteenth edge 215. An adhesive attaches the seventeenth hook/loop surface 317 to the sixteenth edge 216 of the third panel 113 such that the seventeenth hook/loop surface 317 aligns with the sixteenth edge 216. An adhesive attaches the eighteenth hook/loop surface 318 to the seventeenth edge 217 of the third panel 113 such that the eighteenth hook/loop surface 318 aligns with the seventeenth edge 217.

An adhesive attaches the nineteenth hook/loop surface 319 to the nineteenth edge 219 of the third panel 113 such that the nineteenth hook/loop surface 319 aligns with the nineteenth edge 219. An adhesive attaches the twentieth hook/loop surface 320 to the twentieth edge 220 of the third panel 113 such that the twentieth hook/loop surface 320 aligns with the twentieth edge 220. An adhesive attaches the twenty-first hook/loop surface 321 to the twenty-first edge 221 of the third panel 113 such that the twenty-first hook/loop surface 321 aligns with the twenty-first edge 221. An adhesive attaches the twenty-second hook/loop surface 322 to the twenty-second edge 222 of the third panel 113 such that the twenty-second hook/loop surface 322 aligns with the twenty-second edge 222.

The fifth slit 135 is formed in the second panel 112 at the corner formed by the twentieth edge 220 and the twenty-first edge 221. The fifth slit 135 projects towards the thirteenth edge 213 in a direction parallel to the twentieth edge 220. The sixth slit 136 is formed in the second panel 112 at the corner formed by the fifteenth edge 215 and the sixteenth edge 216. The sixth slit 136 projects towards the thirteenth edge 213 in a direction parallel to the sixteenth edge 216.

The following two paragraphs describe the assembly of the fourth panel 114.

An adhesive attaches the twenty-third hook/loop surface 323 to the twenty-fourth edge 224 of the fourth panel 114 such that the twenty-third hook/loop surface 323 aligns with the twenty-fourth edge 224. An adhesive attaches the twenty-fourth hook/loop surface 324 to the twenty-fifth edge 225 of the fourth panel 114 such that the twenty-fourth hook/loop surface 324 aligns with the twenty-fifth edge 225. An adhesive attaches the twenty-fifth hook/loop surface 325 to the twenty-seventh edge 227 of the fourth panel 114 such that the twenty-fifth hook/loop surface 325 aligns with the twenty-seventh edge 227. An adhesive attaches the twenty-sixth hook/loop surface 326 to the twenty-eighth edge 228 of the fourth panel 114 such that the twenty-sixth hook/loop surface 326 aligns with the twenty-eighth edge 228.

The twenty-third hook/loop surface 323 and the twenty-fourth hook/loop surface 324 are applied to the surface of the fourth panel 114 that is opposite to the surface that contains the twenty-fifth hook/loop surface 325 and the twenty-sixth hook/loop surface 326.

This paragraph describes the assembly of the fifth panel 115. An adhesive attaches the twenty-seventh hook/loop surface 327 to the thirtieth edge 230 of the fifth panel 115 such that the twenty-seventh hook/loop surface 327 aligns with the thirtieth edge 230. An adhesive attaches the twenty-eighth hook/loop surface 328 to the thirty-first edge 231 of the fifth panel 115 such that the twenty-eighth hook/loop surface 328 aligns with the thirty-first edge 231. An adhesive attaches the twenty-ninth hook/loop surface 329 to the thirty-third edge 233 of the fifth panel 115 such that the twenty-ninth hook/loop surface 329 aligns with the thirty-third edge 233. An adhesive attaches the thirtieth hook/loop surface 330 to the thirty-fourth edge 234 of the fifth panel 115 such that the thirtieth hook/loop surface 330 aligns with the thirty-fourth edge 234.

This paragraph describes the assembly of the sixth panel 116. An adhesive attaches the thirty-first hook/loop surface 331 to the thirty-sixth edge 236 of the sixth panel 116 such that the thirty-first hook/loop surface 331 aligns with the thirty-sixth edge 236. An adhesive attaches the thirty-second hook/loop surface 332 to the thirty-seventh edge 237 of the sixth panel 116 such that the thirty-second hook/loop surface 332 aligns with the thirty-seventh edge 237. An adhesive attaches the thirty-third hook/loop surface 333 to the thirty-seventh edge 237 of the sixth panel 116 such that the thirty-third hook/loop surface 333 aligns with the thirty-seventh edge 237. An adhesive attaches the thirty-fourth hook/loop surface 334 to the thirty-eighth edge 238 of the sixth panel 116 such that the thirty-fourth hook/loop surface 334 aligns with the thirty-eighth edge 238.

This paragraph describes the assembly of the seventh panel 117. An adhesive attaches the thirty-fifth hook/loop surface 335 to the fortieth edge 240 of the seventh panel 117 such that the thirty-fifth hook/loop surface 335 aligns with the fortieth edge 240. An adhesive attaches the thirty-sixth hook/loop surface 336 to the forty-first edge 241 of the seventh panel 117 such that the thirty-sixth hook/loop surface 336 aligns with the forty-first edge 241. An adhesive attaches the thirty-seventh hook/loop surface 337 to the forty-first edge 241 of the seventh panel 117 such that the thirty-seventh hook/loop surface 337 aligns with the forty-first edge 241. An adhesive attaches the thirty-eighth hook/loop surface 338 to the forty-second edge 242 of the seventh panel 117 such that the thirty-eighth hook/loop surface 338 aligns with the forty-second edge 242.

This paragraph and the following two paragraphs describe the assembly of the jumpsuit 121. The jumpsuit 121 is assembled from the first panel 111 and the second panel 112.

The second hook/loop surface 302 presses into the first hook/loop surface 301 to form a first hook and loop fastener. The first hook and loop fastener wraps the first panel 111 around the arm of the patient 141. The third hook/loop surface 303 presses into the first hook/loop surface 301 to form a second hook and loop fastener. The second hook and loop fastener wraps the first panel 111 around the arm of the patient 141. The eighth hook/loop surface 308 presses into the first hook/loop surface 301 to form a third hook and loop fastener. The third hook and loop fastener wraps the first panel 111 around the arm of the patient 141. The ninth hook/loop surface 309 presses into the first hook/loop surface 301 to form a fourth hook and loop fastener. The fourth hook and loop fastener wraps the first panel 111 around the arm of the patient 141.

The thirteenth hook/loop surface 313 presses into the seventh hook/loop surface 307 to form a fifth hook and loop fastener that attaches the second panel 112 to the first panel 111 to form a covering around the patient 141. The twelfth hook/loop surface 312 presses into the sixth hook/loop surface 306 to form a sixth hook and loop fastener that attaches the second panel 112 to the first panel 111 to form a covering around the patient 141. The eleventh hook/loop surface 311 presses into the fifth hook/loop surface 305 to form a seventh hook and loop fastener that attaches the second panel 112 to the first panel 111 to form a covering around the patient 141. The tenth hook/loop surface 310 presses into the fourth hook/loop surface 304 to form an eighth hook and loop fastener that attaches the second panel 112 to the first panel 111 to form a covering around the patient 141.

This paragraph and the following two paragraphs describe the assembly of the dress 122. The dress 122 is assembled from the third panel 113, the fourth panel 114, and the fifth panel 115.

The fifteenth hook/loop surface 315 presses into the fourteenth hook/loop surface 314 to form a ninth hook and loop fastener. The ninth hook and loop fastener wraps the third panel 113 the arm of the patient 141. The sixteenth hook/loop surface 316 presses into the fourteenth hook/loop surface 314 to form a tenth hook and loop fastener. The tenth hook and loop fastener wraps the third panel 113 around the arm of the patient 141. The twenty-first hook/loop surface 321 presses into the fourteenth hook/loop surface 314 to form an eleventh hook and loop fastener. The eleventh hook and loop fastener wraps the third panel 113 around the arm of the patient 141.

The twenty-second hook/loop surface 322 presses into the fourteenth hook/loop surface 314 to form a twelfth hook and loop fastener. The twelfth hook and loop fastener wraps the third panel 113 around the arm of the patient 141. The twenty-sixth hook/loop surface 326 presses into the twentieth hook/loop surface 320 to form a thirteenth hook and loop fastener that attaches the fourth panel 114 to the third panel 113 to form a covering around the patient 141. The twenty-fifth hook/loop surface 325 presses into the nineteenth hook/loop surface 319 to form a fourteenth hook and loop fastener that attaches the fourth panel 114 to the third panel 113 to form a covering around the patient 141.

The twenty-seventh hook/loop surface 327 presses into the seventeenth hook/loop surface 317 to form a fifteenth hook and loop fastener that attaches the fifth panel 115 to the third panel 113 to form a covering around the patient 141. The twenty-eighth hook/loop surface 328 presses into the eighteenth hook/loop surface 318 to form a sixteenth hook and loop fastener that attaches the fifth panel 115 to the third panel 113 to form a covering around the patient 141. The thirtieth hook/loop surface 330 presses into the twenty-third hook/loop surface 323 to form a seventeenth hook and loop fastener that attaches the fifth panel 115 to the fourth panel 114 to form a covering around the patient 141. The twenty-ninth hook/loop surface 329 presses into the twenty-fourth hook/loop surface 324 to form an eighteenth hook and loop fastener that attaches the fifth panel 115 to the fourth panel 114 to form a covering around the patient 141.

This paragraph and the following paragraph describe the assembly of the pair of socks 123. The pair of socks 123 are assembled from the sixth panel 116 and the seventh panel 117.

The thirty-first hook/loop surface 331 presses into the thirty-fourth hook/loop surface 334 to form a nineteenth hook and loop fastener that attaches the sides of the sixth panel 116 to form a covering around a leg of the patient 141. The thirty-second hook/loop surface 332 presses into the thirty-third hook/loop surface 333 to form a twentieth hook and loop fastener that encloses an open end formed in the sixth panel 116 to form a covering around a leg of the patient 141. The thirty-fifth hook/loop surface 335 presses into the thirty-eighth hook/loop surface 338 to form a twenty-first hook and loop fastener that attaches the sides of the seventh panel 117 to form a covering around a leg of the patient 141. The thirty-sixth hook/loop surface 336 presses into the thirty-seventh hook/loop surface 337 to form a twenty-second hook and loop fastener that encloses an open end formed in the seventh panel 117 to form a covering around a leg of the patient 141.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyano-acrylates, silicone, or latex based adhesives.

Cruciform: As used in this disclosure, a cruciform is a structure has a cross shape.

Flair: As used in this disclosure, a flair is a curvature that is formed in a structure. Specifically, a flair refers to a gradual curvature in a direction away from a plane or axis defined by the structure. This definition is intended to include rectilinear structures that form an angle to an axis of symmetry.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook/loop surface" with the understanding that when the two objects are fastened together one of the two objects will have a hook surface and the remaining object will have the loop surface.

Infant: As used in this disclosure, an infant refers to a human child who: 1) is under 18 months old; and, 2) has not yet learned to walk.

Patient: As used in this disclosure, a patient is a person who is designated to receive a medical treatment, therapy or service. The term patient may be extended to an animal when used within the context of the animal receiving veterinary treatment or services Raw Edges: As used in this disclosure, a raw edge refers to one of two edges that are formed when a textile is partially cut from the edge towards the center of the fabric. The end of the partial slit is called the termination point.

Rectilinear: As used in this disclosure, rectilinear is an adjective that is used to describe an object that: 1) moves in a straight line or lines; 2) consists of a straight line or lines; 3) is bounded by a straight line or lines; or, 4) is otherwise characterized by a straight line or lines.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, or a seam formed using an adhesive.

Slit: As used in this disclosure, a slit is a long narrow cut or opening that is formed in or through an object.

Textile: As used in this disclosure, a textile is a material that is woven, knitted, braided or felted. Synonyms in common usage for this definition include fabric and cloth.

Therapeutic: As used in this disclosure, therapeutic is an adjective that refers to a medical, ameliorative, or hygienic substance, process, or procedure.

Tube: As used in this disclosure, a tube is a flexible hollow cylindrical device that is used for transporting liquids and gases. The line that connects the center of the first base of the cylinder to the center of the second base of the cylinder is referred to as the center axis of the tube or the centerline of the tube. In this disclosure, the terms inner diameter of a tube and outer diameter of a tube are used as they would be used by those skilled in the plumbing arts.

With respect to the above description, it is to be realized that the optimum dimensional relationship for the various components of the invention described above and in FIGS. 1 through 11 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A patient gown comprising a plurality of panels and a plurality of detachable fasteners;

wherein the plurality of panels are interconnected using the plurality of detachable fasteners to form a plurality of garments;

wherein the plurality of detachable fasteners removably attach one or more panels selected from the plurality of panels to form a garment selected from the plurality of garments;

wherein the patient gown is a therapeutic garment;

wherein the patient gown is configured for use with a patient;

wherein the patient is a low birthweight infant receiving medical therapy;

wherein the therapy further comprises medical tubing;

wherein each of the plurality of panels is a textile;

wherein the plurality of detachable fasteners are adjustable such that any detachable fastener selected from the plurality of detachable fasteners can be reconfigured to accommodate the insertion of the medical tubing through the selected detachable fastener;

wherein the patient gown is configured for use with a cap;

wherein each garment selected from the plurality of garment comprises one or more panels selected from the plurality of panels and one or more detachable fasteners selected from the plurality of detachable fasteners;

wherein no permanent attachments are used to assembly any garment selected from the plurality of garments;

wherein each of the plurality of detachable fasteners is a hook/loop surface;

wherein each of the plurality of garments is an article of apparel that is worn by the patient;

wherein the assembly of any garment selected from the plurality of garments allows for the medical tubing required for the care of the patient to be inserted through the selected garment at any point along any seam that joins two panels selected from the plurality of panels;

wherein the plurality of panels comprises a first panel, a second panel, a third panel, a fourth panel, a fifth panel, a sixth panel, and a seventh panel;

wherein the first panel is a textile that is cut in the shape of a cruciform;

wherein the second panel is a textile that is cut in the shape of a rectangle;

wherein the third panel is a textile that is cut in a rectilinear shape;

wherein the fourth panel is a textile that is cut in a rectilinear shape;

wherein the fifth panel is a textile that is cut in a rectilinear shape;

wherein the sixth panel is a textile that is cut in the shape of a rectangle;

wherein the seventh panel is a textile that is cut in the shape of a rectangle;

wherein the first panel is further defined with a first edge, a second edge, a third edge, a fourth edge, a fifth edge, a sixth edge, a seventh edge, and an eighth edge;

wherein the second panel is further defined with a ninth edge, a tenth edge, an eleventh edge, and a twelfth edge;

wherein the third panel is further defined with a thirteenth edge, a fourteenth edge, a fifteenth edge, a sixteenth edge, a seventeenth edge, an eighteenth edge, a nineteenth edge, a twentieth edge, a twenty-first edge, and a twenty-second edge;

wherein the fourth panel is further defined with a twenty-third edge, a twenty-fourth edge, a twenty-fifth edge, a twenty-sixth edge, a twenty-seventh edge, and a twenty-eighth edge;

wherein the fifth panel is further defined with a twenty-ninth edge, a thirtieth edge, a thirty-first edge, a thirty-second edge, a thirty-third edge, and a thirty-fourth edge;

wherein the sixth panel is further defined with a thirty-fifth edge, a thirty-sixth edge, a thirty-seventh edge, and a thirty-eighth edge;

wherein the seventh panel is further defined with a thirty-ninth edge, a fortieth edge, a forty-first edge, and a forty-second edge.

2. The patient gown according to claim 1 wherein the third panel comprises two flaired edges.

3. The patient gown according to claim 2 wherein the plurality of garments comprises a jumpsuit, a dress, and a pair of socks;

wherein the jumpsuit covers the patient;

wherein the dress covers the patient;

wherein the pair of socks cover the patient.

4. The patient gown according to claim 3 wherein the first panel further comprises a first slit, a second slit, and a third slit;

wherein the first slit is cut in the first panel;

wherein the second slit is cut in the first panel;

wherein the third slit is cut in the first panel that allows for the freedom of movement of the legs of the patient;

wherein the first slit forms a first raw edge and a second raw edge;

wherein the second slit forms a third raw edge and a fourth raw edge;

wherein the third slit forms a fifth raw edge and a sixth raw edge;

wherein the second panel further comprises a fourth slit;

wherein the fourth slit is cut in the second panel;

wherein the fourth slit forms a seventh raw edge and an eighth raw edge.

5. The patient gown according to claim 4 wherein the third panel further comprises a fifth slit and a sixth slit;

wherein the fifth slit is cut in the third panel;

wherein the sixth slit is cut in the third panel;

wherein the fifth slit forms a ninth raw edge and a tenth raw edge;

wherein the sixth slit forms an eleventh raw edge and a twelfth raw edge.

6. The patient gown according to claim 5 wherein the plurality of detachable fasteners comprises a first hook/loop surface, a second hook/loop surface, a third hook/loop surface, a fourth hook/loop surface, a fifth hook/loop surface, a sixth hook/loop surface, a seventh hook/loop surface, an eighth hook/loop surface, and a ninth hook/loop surface;

wherein the first hook/loop surface attaches to the first edge of the first panel such that the first hook/loop surface aligns with the first edge;

wherein the second hook/loop surface attaches to the second edge of the first panel such that the second hook/loop surface aligns with the second edge;

wherein the third hook/loop surface attaches to the third edge of the first panel such that the third hook/loop surface aligns with the third edge;

wherein the fourth hook/loop surface attaches to the fourth edge of the first panel such that the fourth hook/loop surface aligns with the fourth edge;

wherein the fifth hook/loop surface attaches to the sixth raw edge of the first panel such that the fifth hook/loop surface aligns with the sixth raw edge;

wherein the sixth hook/loop surface attaches to the fifth raw edge of the first panel such that the sixth hook/loop surface aligns with the fifth raw edge;

wherein the seventh hook/loop surface attaches to the sixth edge of the first panel such that the seventh hook/loop surface aligns with the sixth edge;

wherein the eighth hook/loop surface attaches to the seventh edge of the first panel such that the eighth hook/loop surface aligns with the seventh edge;

wherein the ninth hook/loop surface attaches to the eighth edge of the first panel such that the ninth hook/loop surface aligns with the eighth edge;

wherein the first slit is formed in the first panel at the corner formed by the sixth edge and the seventh edge;

wherein the first slit projects towards the first edge in a direction parallel to the sixth edge;

wherein the second slit is formed in the first panel at the corner formed by the third edge and the fourth edge;

wherein the second slit projects towards the first edge in a direction parallel to the fourth edge;

wherein the third slit is formed in the first panel at the midpoint of the fifth edge;

wherein the third slit projects towards the first edge in a direction perpendicular to the fifth edge.

7. The patient gown according to claim 6 wherein the plurality of detachable fasteners further comprises a tenth hook/loop surface, an eleventh hook/loop surface, a twelfth hook/loop surface, and a thirteenth hook/loop surface;

wherein the tenth hook/loop surface attaches to the tenth edge of the second panel such that the tenth hook/loop surface aligns with the tenth edge;

wherein the eleventh hook/loop surface attaches to the eighth raw edge of the second panel such that the eleventh hook/loop surface aligns with the eighth raw edge;

wherein the twelfth hook/loop surface attaches to the seventh raw edge of the second panel such that the twelfth hook/loop surface aligns with the seventh raw edge;

wherein the thirteenth hook/loop surface attaches to the twelfth edge of the second panel such that the thirteenth hook/loop surface aligns with the twelfth edge;

wherein the fourth slit is formed in the second panel at the midpoint of the eleventh edge;

wherein the fourth slit projects towards the ninth edge in a direction perpendicular to the eleventh edge.

8. The patient gown according to claim 7 wherein the plurality of detachable fasteners a fourteenth hook/loop surface, a fifteenth hook/loop surface, a sixteenth hook/loop surface, a seventeenth hook/loop surface, an eighteenth hook/loop surface, and a nineteenth hook/loop surface, a twentieth hook/loop surface, a twenty-first hook/loop surface, a twenty-second hook/loop surface, wherein the fourteenth hook/loop surface attaches to the thirteenth edge of the third panel such that the fourteenth hook/loop surface aligns with the thirteenth edge;

wherein the fifteenth hook/loop surface attaches to the fourteenth edge of the third panel such that the fifteenth hook/loop surface aligns with the fourteenth edge;

wherein the sixteenth hook/loop surface attaches to the fifteenth edge of the third panel such that the sixteenth hook/loop surface aligns with the fifteenth edge;

wherein the seventeenth hook/loop surface attaches to the sixteenth edge of the third panel such that the seventeenth hook/loop surface aligns with the sixteenth edge;

wherein the eighteenth hook/loop surface attaches to the seventeenth edge of the third panel such that the eighteenth hook/loop surface aligns with the seventeenth edge;

wherein the nineteenth hook/loop surface attaches to the nineteenth edge of the third panel such that the nineteenth hook/loop surface aligns with the nineteenth edge;

wherein the twentieth hook/loop surface attaches to the twentieth edge of the third panel such that the twentieth hook/loop surface aligns with the twentieth edge;

wherein the twenty-first hook/loop surface attaches to the twenty-first edge of the third panel such that the twenty-first hook/loop surface aligns with the twenty-first edge;

wherein the twenty-second hook/loop surface attaches to the twenty-second edge of the third panel such that the twenty-second hook/loop surface aligns with the twenty-second edge;

wherein the fifth slit is formed in the second panel at the corner formed by the twentieth edge and the twenty-first edge;

wherein the fifth slit projects towards the thirteenth edge in a direction parallel to the twentieth edge;

wherein the sixth slit is formed in the second panel at the corner formed by the fifteenth edge and the sixteenth edge;

wherein the sixth slit projects towards the thirteenth edge in a direction parallel to the sixteenth edge.

9. The patient gown according to claim 8 wherein the plurality of detachable fasteners further comprises a twenty-third hook/loop surface, a twenty-fourth hook/loop surface, a twenty-fifth hook/loop surface, and a twenty-sixth hook/loop surface;

wherein the twenty-third hook/loop surface attaches to the twenty-fourth edge of the fourth panel such that the twenty-third hook/loop surface aligns with the twenty-fourth edge;

wherein the twenty-fourth hook/loop surface attaches to the twenty-fifth edge of the fourth panel such that the twenty-fourth hook/loop surface aligns with the twenty-fifth edge;

wherein the twenty-fifth hook/loop surface attaches to the twenty-seventh edge of the fourth panel such that the twenty-fifth hook/loop surface aligns with the twenty-seventh edge;

wherein the twenty-sixth hook/loop surface attaches to the twenty-eighth edge of the fourth panel such that the twenty-sixth hook/loop surface aligns with the twenty-eighth edge.

10. The patient gown according to claim 9 wherein the twenty-third hook/loop surface and the twenty-fourth hook/loop surface attach to the surface of the fourth panel that is opposite to the surface that receives the twenty-fifth hook/loop surface and the twenty-sixth hook/loop surface.

11. The patient gown according to claim 10 wherein the plurality of detachable fasteners further comprises a twenty-seventh hook/loop surface, a twenty-eighth hook/loop surface, a twenty-ninth hook/loop surface, a thirtieth hook/loop surface;

wherein the twenty-seventh hook/loop surface attaches to the thirtieth edge of the fifth panel such that the twenty-seventh hook/loop surface aligns with the thirtieth edge;

wherein the twenty-eighth hook/loop surface attaches to the thirty-first edge of the fifth panel such that the twenty-eighth hook/loop surface aligns with the thirty-first edge;

wherein the twenty-ninth hook/loop surface attaches to the thirty-third edge of the fifth panel such that the twenty-ninth hook/loop surface aligns with the thirty-third edge;

wherein the thirtieth hook/loop surface attaches to the thirty-fourth edge of the fifth panel such that the thirtieth hook/loop surface aligns with the thirty-fourth edge.

12. The patient gown according to claim 11 wherein the plurality of detachable fasteners further comprises a thirty-first hook/loop surface, a thirty-second hook/loop surface, a thirty-third hook/loop surface, a thirty-fourth hook/loop surface, a thirty-fifth hook/loop surface, a thirty-sixth hook/loop surface, a thirty-seventh hook/loop surface, and a thirty-eighth hook/loop surface;

wherein the thirty-first hook/loop surface attaches to the thirty-sixth edge of the sixth panel such that the thirty-first hook/loop surface aligns with the thirty-sixth edge;

wherein the thirty-second hook/loop surface attaches to the thirty-seventh edge of the sixth panel such that the thirty-second hook/loop surface aligns with the thirty-seventh edge;

wherein the thirty-third hook/loop surface attaches to the thirty-seventh edge of the sixth panel such that the thirty-third hook/loop surface aligns with the thirty-seventh edge;

wherein the thirty-fourth hook/loop surface attaches to the thirty-eighth edge of the sixth panel such that the thirty-fourth hook/loop surface aligns with the thirty-eighth edge;

wherein the thirty-fifth hook/loop surface attaches to the fortieth edge of the seventh panel such that the thirty-fifth hook/loop surface aligns with the fortieth edge;

wherein the thirty-sixth hook/loop surface attaches to the forty-first edge of the seventh panel such that the thirty-sixth hook/loop surface aligns with the forty-first edge;

wherein the thirty-seventh hook/loop surface attaches to the forty-first edge of the seventh panel such that the thirty-seventh hook/loop surface aligns with the forty-first edge;

wherein the thirty-eighth hook/loop surface attaches to the forty-second edge of the seventh panel such that the thirty-eighth hook/loop surface aligns with the forty-second edge.

13. The patient gown according to claim 12 wherein the jumpsuit is assembled from the first panel and the second panel;

wherein the second hook/loop surface presses into the first hook/loop surface to form a first hook and loop fastener;

wherein the first hook and loop fastener wraps the first panel around the arm of the patient;

wherein the third hook/loop surface presses into the first hook/loop surface to form a second hook and loop fastener;

wherein the second hook and loop fastener wraps the first panel around the arm of the patient;

wherein the eighth hook/loop surface presses into the first hook/loop surface to form a third hook and loop fastener;

wherein the third hook and loop fastener wraps the first panel around the arm of the patient;

wherein the ninth hook/loop surface presses into the first hook/loop surface to form a fourth hook and loop fastener;

wherein the fourth hook and loop fastener wraps the first panel around the arm of the patient;

wherein the thirteenth hook/loop surface presses into the seventh hook/loop surface to form a fifth hook and loop fastener that attaches the second panel to the first panel to form a covering around the patient;

wherein the twelfth hook/loop surface presses into the sixth hook/loop surface to form a sixth hook and loop fastener that attaches the second panel to the first panel to form a covering around the patient;

wherein the eleventh hook/loop surface presses into the fifth hook/loop surface to form a seventh hook and loop fastener that attaches the second panel to the first panel to form a covering around the patient;

wherein the tenth hook/loop surface presses into the fourth hook/loop surface to form an eighth hook and loop fastener that attaches the second panel to the first panel to form a covering around the patient.

14. The patient gown according to claim 13 wherein the dress is assembled from the third panel, the fourth panel, and the fifth panel;

wherein the fifteenth hook/loop surface presses into the fourteenth hook/loop surface to form a ninth hook and loop fastener;

wherein the ninth hook and loop fastener wraps the third panel the arm of the patient;

wherein the sixteenth hook/loop surface presses into the fourteenth hook/loop surface to form a tenth hook and loop fastener;

wherein the tenth hook and loop fastener wraps the third panel around the arm of the patient;

wherein the twenty-first hook/loop surface presses into the fourteenth hook/loop surface to form an eleventh hook and loop fastener;

wherein the eleventh hook and loop fastener wraps the third panel around the arm of the patient;

wherein the twenty-second hook/loop surface presses into the fourteenth hook/loop surface to form a twelfth hook and loop fastener;

wherein the twelfth hook and loop fastener wraps the third panel around the arm of the patient;

wherein the twenty-sixth hook/loop surface presses into the twentieth hook/loop surface to form a thirteenth hook and loop fastener that attaches the fourth panel to the third panel to form a covering around the patient;

wherein the twenty-fifth hook/loop surface presses into the nineteenth hook/loop surface to form a fourteenth hook and loop fastener that attaches the fourth panel to the third panel to form a covering around the patient;

wherein the twenty-seventh hook/loop surface presses into the seventeenth hook/loop surface to form a fifteenth hook and loop fastener that attaches the fifth panel to the third panel to form a covering around the patient;

wherein the twenty-eighth hook/loop surface presses into the eighteenth hook/loop surface to form a sixteenth hook and loop fastener that attaches the fifth panel to the third panel to form a covering around the patient;

wherein the thirtieth hook/loop surface presses into the twenty-third hook/loop surface to form a seventeenth hook and loop fastener that attaches the fifth panel to the fourth panel to form a covering around the patient;

wherein the twenty-ninth hook/loop surface presses into the twenty-fourth hook/loop surface to form an eighteenth hook and loop fastener that attaches the fifth panel to the fourth panel to form a covering around the patient.

15. The patient gown according to claim 14 wherein the pair of socks are assembled from the sixth panel and the seventh panel;

wherein the thirty-first hook/loop surface presses into the thirty-fourth hook/loop surface to form a nineteenth hook and loop fastener that attaches the sides of the sixth panel to form a covering around a leg of the patient;

wherein the thirty-second hook/loop surface presses into the thirty-third hook/loop surface to form a twentieth hook and loop fastener that encloses an open end formed in the sixth panel to form a covering around a leg of the patient;

wherein the thirty-fifth hook/loop surface presses into the thirty-eighth hook/loop surface to form a twenty-first hook and loop fastener that attaches the sides of the seventh panel to form a covering around a leg of the patient;

wherein the thirty-sixth hook/loop surface presses into the thirty-seventh hook/loop surface to form a twenty-second hook and loop fastener that encloses an open end formed in the seventh panel to form a covering around a leg of the patient.

* * * * *